United States Patent [19]

Fojt et al.

[11] 4,149,466

[45] Apr. 17, 1979

[54] EXPLOSIVE DEVICE

[75] Inventors: Lajos Fojt; Jozsef Kirschner; Laszlo Nemeth, all of Tatabanya; Janos Thesz, Budapest; Peter Tuti, Erd, all of Hungary

[73] Assignees: Banyaszati Kutato Intezet; Chinoin Gyogyszer es Vegyeszeti Termekek, both of Budapest, Hungary

[21] Appl. No.: 783,314

[22] Filed: Mar. 31, 1977

[51] Int. Cl.[2] ..... F42C 19/00

[52] U.S. Cl. ..... 102/201

[58] Field of Search ..... 102/70.2 R, 70.2 A

[56] References Cited

U.S. PATENT DOCUMENTS

| | | | |
|---|---|---|---|
| 3,167,015 | 1/1965 | Smith et al. | 102/70.2 A |
| 3,198,118 | 8/1965 | Lorenz | 102/70.2 R |
| 3,362,329 | 1/1968 | Epstein | 102/70.2 R |
| 3,791,302 | 2/1974 | McLeod | 102/70.2 A |
| 3,812,783 | 5/1974 | Yang et al. | 102/70.2 A |

*Primary Examiner*—Charles T. Jordan

*Attorney, Agent, or Firm*—Young & Thompson

[57] ABSTRACT

An explosive device comprises an explosive charge and an initiator, the initiator having a discharge lamp optically coupled with said explosive charge and connected to a voltage source via a first switch. According to the invention said discharge lamp has a series resistor shunted via a second switch which is open before and closed when the explosive charge is initiated. The glow discharge evoked through said series resistor cannot initiate the explosive charge, but it shortens the time delay of the avalanche discharge and makes it independent of the stochastic natural ionization.

5 Claims, 3 Drawing Figures

EXPLOSIVE DEVICE

Figure 1:
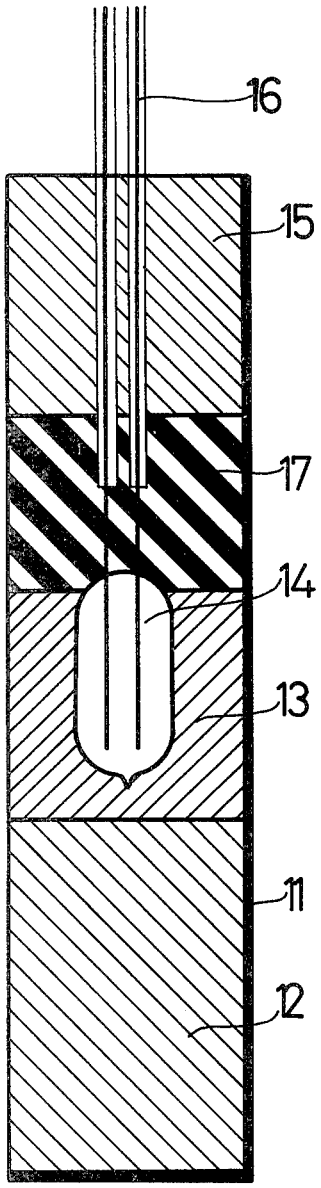

The present invention relates to an explosive device having an explosive charge and an initiator, the initiator comprising a discharge lamp optically coupled with said explosive charge and connected to a voltage source.

Various explosive devices are conventional, consisting of a great variety of explosive charges and initiators. In general, the charge consists of a primary explosive and a secondary explosive.

The secondary explosives cannot be initiated directly, or they can be initiated only with difficulties. For this reason, the primary explosives are utilized which explode in response to heat, percussion, etc., and are capable of transmitting the explosion to the secondary explosive.

In modern explosion technique, there is an ever-increasing requirement for explosive devices which can be set with extreme accuracy to respond to certain factors, for example with respect to the instant of explosion of another explosive device. The need for an extremely controlled response exists in modern explosion technology, for example, in the so-called "cleavage of strata with oppositely directed initiation" used in the mining of hydrocarbons and in the opening up of water sources, wherein the explosive charge is lowered into a drill hole and initiated by means of detonators provided on both ends of the charge, this initiation taking place simultaneously from both ends. By means of the pressure head created by the shock waves meeting each other in the center, the stratum is split up. The meeting point of the shock waves is located (as planned) exactly in the middle only if the two detonators have been initiated synchronously with maximum accuracy (Hungarian Pat. No. 165,174). In a customary explosive (compressed hexogen = cyclotrimethylenetrinitramine) the detonating velocity is approximately 8 mm./μsec. Thus, if merely 500 μsec. elapse between the instants of initiating the two detonators, then the shock waves will meet at a point which is displaced from the center by 2,000 mm., whereby the cleavage effect is significantly reduced.

It is known to use light sources to initiate explosive charges with high accuracy. One sort of the light sources which would be advantageous because of its commonness is the discharge lamp. It has not been, however, hitherto widely used because of a special problem. In the discharge lamps the starting points of the avalanche discharge which gives the initiating light effect are the ions produced by the natural radioactivity. The natural radioactivity being stochastic the number of these ions can deviate relatively significantly from each other in the individual discharge lamps. This will result in different time delays relative to the switching on of the threshold voltage which evokes the avalanche discharge. In the case of the "cleavage of strata with oppositely directed initiation" and other synchronous initiations such deviations in the time delay are not permitted.

The object of the present invention is to provide an explosive device initiated by a discharge lamp, in which the time delay of the avalanche discharge is shortened and made independent of the stochastic natural ionization.

The proposed explosive device has an explosive charge and an initiator, the initiator comprising a discharge lamp optically coupled with said explosive charge and connected to a voltage source via a first switching means. According to the invention said discharge lamp has a series resistor shunted via a second switching means which is open before and closed when the explosive charge is initiated.

In an advantageous embodiment of the invention two or more discharge lamps are connected in series.

According to a further embodiment these discharge lamps are identical, each being shunted by a resistor, all resistors being of equal value.

Advantageously an indicator is series-connected with the discharge lamp.

In accordance with another advantageous embodiment a radioactive isotope is disposed in the discharge lamp.

The invention shortens the time delay of the avalanche discharge in the discharge lamps and makes it independent of the stochastic natural ionization. This makes it possible to use discharge lamps in explosive devices which need extreme accuracy in their initiation.

Figure 2:
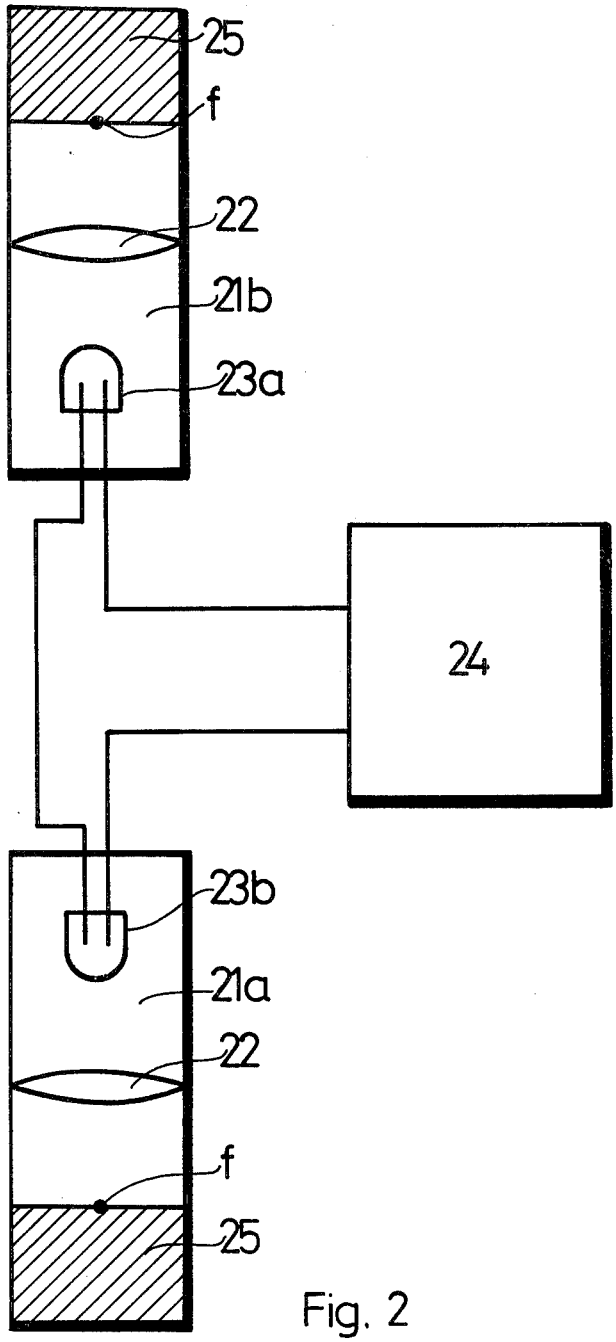
Figure 3:
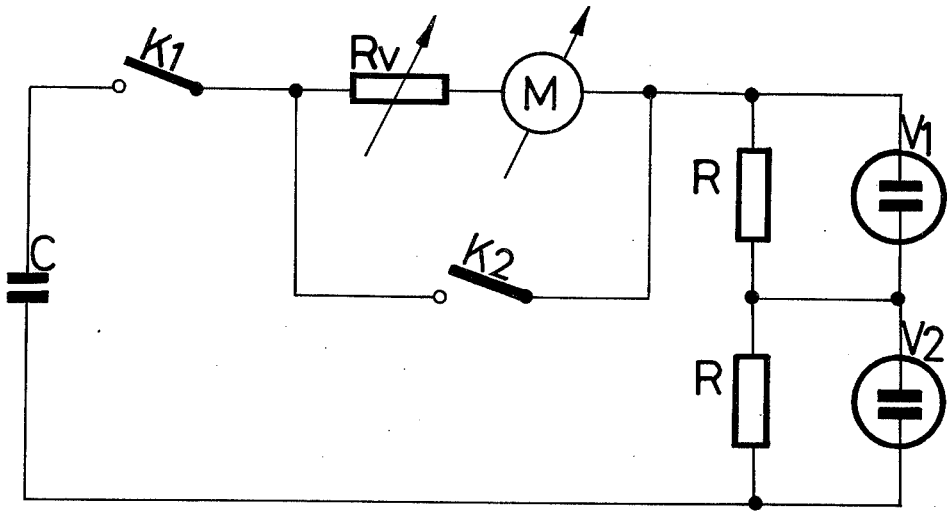

The invention will be explained in greater detail below with reference to the appended drawings showing several embodiments thereof wherein FIG. 1 is a longitudinal sectional view of an electric detonator cap;

FIG. 2 shows a block circuit diagram of two detonator caps to be initiated simultaneously and utilized in a common explosive device; and FIG. 3 shows the electric switching arrangement of an explosive device comprising two series-connected discharge lamps.

FIG. 1 shows a detonator cap consisting conventionally of a casing 11 as well as a secondary explosive charge 12 and a primary explosive charge 13 arranged in a superimposed relationship. In accordance with a concrete embodiment, the primary explosive charge 13 consists of 100 mg. of lead azide and the secondary explosive charge 12 consists of hexogen, the weight of which corresponds to the detonator cap size 8.

A discharge lamp 14 is embedded in the primary explosive charge. The discharge lamp is connected by way of two insulated conductors 16 to a voltage source, not shown—in case of a given discharge lamp (type NGV-6 of United Incandescent Lamp Works, Hungary)—namely a capacitor charged to a voltage of 1,500 V (200 μF) via a high-speed switch (not illustrated). A plug 17 made of an insulating material is arranged above the primary explosive charge 13 and the light source 14, this plug having two bores for the two conductors 16. Above the plug 17, a blocking element 15 is arranged onto which the casing 11 is pressed, as is conventional. The blocking element 15 also has corresponding passage bores.

All of the components of the detonator cap according to FIG. 1—including the explosive charges 12, 13—are advantageously manufactured of a heat-resistant material so that, in case of a blasting process in a deep drill hole, the detonator cap remains operative—at a temperature of 180°-200° C.—and/or does not become operative prematurely.

The explosive device according to FIG. 2 comprises two identical detonator caps **21*a*, 21*b* which initiate the explosive charge from two directions simultaneously. The detonator caps 21*a*, 21*b* contain each a primary explosive charge 25. An optical lens 22 is disposed above this explosive charge. The focus f of the lens 22 is suitably located exactly on the surface of the explosive charge 25. Respectively one discharge lamp 23*a*** and 23*b* is arranged above the lenses 22. The discharge lamps are electrically connected in series and are in connection with a combined control unit 24 which can be constructed in accordance with FIG. 3.

The switching arrangement according to FIG. 3 comprises two identical, series-connected discharge lamps $V_1$, $V_2$ corresponding to the discharge lamps 23*a*, 23*b* of FIG. 2. Respectively one resistor R of equal value is connected in parallel with the two discharge lamps $V_1$, $V_2$; this ensures that the same voltage is applied to the two discharge lamps. The discharge lamps $V_1$, $V_2$ are connected in series in a closed circuit with a storage capacitor C, provided with a supply circuit (not shown), a switch $K_1$, a series resistor $R_v$ and the indicator M can be short-circuited by way of a switch $K_2$.

The circuit arrangement according to FIG. 3 operates as follows: after charging of the capacitor C, the switch $K_1$ is closed, whereas the switch $K_2$ remains open. At this instant, a glow discharge process begins in the discharge lamps $V_1$, $V_2$ by way of the high-ohmic—suitably controllable—series resistor $R_v$. This glow discharge (preliminary discharge) is indicated with the aid of the indicator M. The preliminary discharge cannot cause an initiation of the explosive charge, because it produces only a minor thermal and light effect. At the desired instant of activation, the switch $K_2$ is closed. At this point in time, the charge accumulated in the capacitor is discharged by way of the discharge lamps $V_1$, $V_2$, whereby the explosive charge is initiated.

If the series resistor $R_v$ and the switch $K_2$ shunting this resistor were not installed in the system, then a deviation in time could occur—at the moment of lighting the discharge lamps—as a result of a stochastic ionization caused by the natural radioactivity. This is so because the starting points of the avalanche discharge in the discharge lamps are determined by the ions formed on account of the natural ionization, the numbers of which can deviate relatively significantly from each other in the individual discharge lamps. However, if a preliminary discharge, i.e. a glow discharge, is evoked in the series-connected discharge tubes, then a number of ions which is larger by orders of magnitude is introduced into both of the discharge tubes than on account of the natural ionization. Consequently, the deviation caused by the natural ionization can be neglected. It is, of course, also possible to utilize the embodiment of FIG. 3 in connection with several discharge lamps. With the use of a single discharge lamp, the delay time is advantageously reduced and the accuracy of the controlled initiation is advantageously improved. Furthermore, with the use of several discharge lamps, a more accurate synchronism can be ensured.

In order to increase the preliminary ionization in the discharge lamps and/or to maintain this preliminary ionization at the same value, it is also advantageous to introduce identical quantities of a radioactive isotope, such as tritium into the discharge lamps.

What is claimed is:

1. An explosive device having an explosive charge and an initiator, the initiator comprising a discharge lamp optically coupled with said explosive charge and connected to a voltage source via a first switching means, said discharge lamp having a series resistor shunted via a second switching means which is open before and closed when the explosive charge is initiated.

2. The explosive device according to claim 1, wherein at least two discharge lamps are connected in series.

3. The explosive device according to claim 2, wherein the discharge lamps are identical, each being shunted by a resistor, all resistors being of equal value.

4. The explosive device according to claim 1, and an indicator series-connected with the discharge lamp.

5. The explosive device according to claim 1, and a radioactive isotope disposed in the discharge lamp.

* * * * *